US006463597B2

(12) United States Patent
Ishimura

(10) Patent No.: US 6,463,597 B2
(45) Date of Patent: Oct. 15, 2002

(54) HAIR WASHING APPARATUS

(75) Inventor: Yoshikazu Ishimura, Osaka (JP)

(73) Assignee: Oohiro Works Ltd., Osaka (JP)

( * ) Notice: Subject to any disclaimer, the term of this patent is extended or adjusted under 35 U.S.C. 154(b) by 0 days.

(21) Appl. No.: 09/907,239

(22) Filed: Jul. 17, 2001

(65) Prior Publication Data

US 2002/0020013 A1 Feb. 21, 2002

(30) Foreign Application Priority Data

Jul. 25, 2000 (JP) ..... 2000-224445
Mar. 13, 2001 (JP) ..... 2001-070059

(51) Int. Cl.[7] ..... A45D 19/00
(52) U.S. Cl. ..... 4/515; 4/517; 4/519
(58) Field of Search ..... 4/515, 517–523

(56) References Cited

U.S. PATENT DOCUMENTS 555,860 A * 3/1896 Hanger ..... 4/517
2,332,904 A * 10/1943 Ellinger ..... 4/517
4,918,767 A * 4/1990 Benting ..... 4/517
5,007,118 A * 4/1991 Ebersole ..... 4/515
5,946,745 A * 9/1999 Magee ..... 4/522

FOREIGN PATENT DOCUMENTS

DE 1 554 035 * 11/1969 ..... 4/517
FR 1 302 328 * 10/1961 ..... 4/520

* cited by examiner

*Primary Examiner*—Charles R. Eloshway
(74) *Attorney, Agent, or Firm*—Wall Marjama & Bilinski LLP

(57) ABSTRACT

Hair washing apparatus which can be selectively adjusted depending on the height of the person performing the hair washing and the person whose hair is being washed. A hair washing unit includes a bowl unit at which a hair washing is performed by the hair washer, a hair washing chair detachably connected to the hair washing unit via a chair supporting arm and a frame. A mechanism for moving the bowl up and down is provided at an upper end of the frame and a mechanism for moving the washing chair up and down is provided at a lower front side of the frame.

2 Claims, 8 Drawing Sheets

HAIR WASHING APPARATUS

FIELD OF THE INVENTION

The present invention relates to a hair washing apparatus used when a hair washing is performed at a barbershop or a beauty salon.

BACKGROUND OF THE INVENTION

Conventionally, when a hair washing is performed by a person for performing a hair washing at a barber shop or a beauty salon, for reducing uneasiness of a person to be washed during a hair washing, a hair dresser performs a hair washing with employing a hair washing chair having a seat part moving up and down by an up and down mechanism, on which the person to be washed is seated, or a hair washing unit having a bowl part moving up and down by an up and down mechanism, at which a hair washing is performed by the person for a hair washing.

FIG. 8 is a view illustrating that the person to be washed receives a hair washing at a conventional hair washing apparatus. The conventional hair washing apparatus is composed of a hair washing chair 80 having an up and down mechanism 81 for moving up and down a position of a seat part, on which the person to be washed is seated, and a hair washing unit provided no up and down mechanism, but provided with a bowl part 90, at which a hair washing is performed by a hair dresser. When a hair washing is performed at the above-described hair washing apparatus, the hair dresser seats a person to be washed on the hair washing chair 80, and moves up the up and don mechanism 81 by pressing a switch or the like (not shown) for operating the up and down mechanism 81 so that a head part of the person to be washed is positioned to the almost same height as the bowl part 90. Thereafter, a seat back is tilted so that the person to be washed lies on his back, and makes the person to be washed place a head part on the bowl part 90, and then a hair washing is stated.

However, according to the conventional hair washing apparatus, while there is a hair washing apparatus provided with an up and down mechanism 81 at a seat part of the hair washing chair 80 as illustrated in FIG. 80, or a hair washing apparatus provided with an up and down mechanism at the bowl part 90 of the hair washing unit, which is not shown, so that a height of the person to be washed is considered, there is no hair washing apparatus which considers a height of the person for performing a hair washing. Therefore, the hair washing apparatus is suited for a height of the person to be washed, which results in that a position of the bowl pat 90 is not suited for a height of the person for performing a hair washing, and thereby increasing uneasiness of a the person for performing a hair washing during a hair washing.

SUMMARY OF THE INVENTION

The present invention is made to solve the above-mentioned problems, and it is an object of the present invention to provide a hair washing apparatus which can be suited for a height of each of a person for performing a hair washing and a person to be washed.

According to a first aspect of the present invention, a hair washing apparatus comprises, a hair washing unit having a hair washing stand, at which a hair washing is performed by a person for performing a hair washing, and a hair washing chair connected to the hair washing unit, on which a person to be washed is seated, wherein the hair washing unit is provided with a hair washing stand moving up and down mechanism for moving up and down the hair washing stand, and a hair washing chair moving up and down mechanism for moving up and down a seat of the hair washing chair.

Therefore, it is possible to adjust height of the bowl part and the hair washing chair according to combinations of each height of a person to be washed and a person for performing a hair washing, thereby reducing uneasiness of each of the person to be washed and the person for performing a hair washing during a hair washing.

According to a second aspect of the present invention, the hair washing apparatus described in the first aspect comprises the hair washing stand moving up and down mechanism having a bowl moving up and down cylinder, one end of which is connected to a frame, and the other end of which is connected to a bowl moving bracket, and a bowl attaching part for attaching the hair washing stand to an upper end of the bowl moving bracket, wherein the hair washing stand is moved up and down by driving the bowl moving up and down cylinder, and the hair washing chair moving up and down mechanism having a chair moving up and down cylinder, one end of which is connected to a base part arranged on a floor face, and the other end of which is connected to a chair moving bracket, and a chair attaching part for detachably attaching a chair to the chair moving bracket tin parallel to the base part via a chair supporting arm, wherein the hair washing chair is moved up and down by driving the chair moving up and down cylinder.

Therefore, each height of the ball part, at which a hair washing is performed, and the hair washing chair can be adjusted according to combinations of each height of a person to be washed and a person for performing a hair washing, thereby reducing uneasiness of each of the person to be washed and the person for performing a hair washing during a hair washing.

Further, the present hair washing apparatus is structured that the hair washing unit is provided with a hair washing chair via the chair supporting arm. Therefore, it is possible to easily arrange the present hair washing apparatus at a barber shop or a beauty salon.

Further, the hair washing chair of the present hair washing apparatus can be easily removed. Therefore, the hair washing chair is removed or replaced according to a condition of the person to be washed, thereby reducing uneasiness of the person to be washed during receiving a hair washing.

According to a third aspect of the present invention, the hair washing apparatus described in the second aspect, wherein the hair washing stand moving up and down mechanism is provided on the upper place of a frame which is stood on the base part and has a front face of rectangle shape and side faces of parallelogram shape, and the hair washing chair moving up and down mechanism is provided on the front face and th lower place, and wherein the hair washing stand moving up and down mechanism is provided with an up and down movement guide arm, extending perpendicularly and downwardly at an upper side of the frame having side faces of parallelogram shape, and the bowl attaching part is provided in parallel to the upper side of the frame with movable upwardly and downwardly, and the bowl moving bracket, which is fixed to a bottom face of the bowl attaching part and extends perpendicularly and downwardly from the bottom face, moves up and down along the up and down movement guide arm, and the hair washing chair moving up and down mechanism moves along an included face of the frame having side faces of parallelogram shape by sliding rollers provided with the chair moving bracket.

Therefore, it is possible to adjust the height of the bowl part and the hair washing chair according to combinations of each height of the person to be washed and the person for performing a hair washing, thereby reducing uneasiness of each of the person to be washed and the person for performing a hair washing during a hair washing.

Further, the present hair washing is provided with a moving up and down mechanism for moving up and down the bowl part and a moving up and down mechanism for moving up and down the hair washing chair, on the same frame. Therefore, it is possible to reduce an area for attaching the hair washing apparatus.

DETAILED DESCRIPTION OF THE PREFERRED EMBODIMENTS

Embodiment 1.

Hereinafter, a hair washing apparatus according to a first embodiment will be described with referring to FIGS. 1 to 3.

Figure 1:
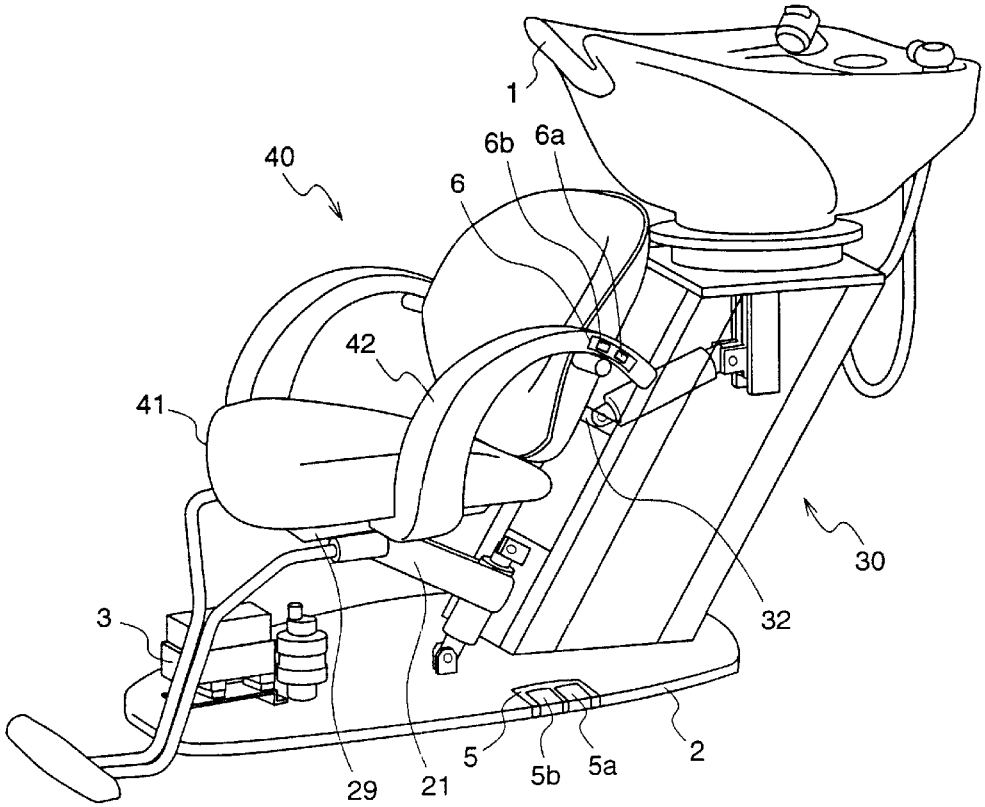
FIG. 1 is a perspective view illustrating an external appearance of a hair washing apparatus according to a first embodiment of the present invention.

FIG. 1 is a perspective view illustrating an external appearance of a hair washing apparatus according to the first embodiment.

In FIG. 1, this hair washing apparatus is composed of a rectangle-frame-shaped frame column construction part 30 extending obliquely and upwardly which is provided on a base part 2 arranged at a floor face, a bowl part 1 for performing a hair washing, which is provided on an upper face of the frame column construction part 30 with moveable up and down via a bowl moving up and down mechanism 10 provided on an upper position of the frame column construction part 30, and a chair 40, on which a person to be washed is seated, which is provided on a front face and lower position of the frame column construction part 30 with moveable up and down via a chair moving up and down mechanism 20 and a chair supporting arm 21.

Hereinafter, respective parts of the hair washing apparatus will be described in more details with referring to FIGS. 2 and 3.

Figure 2:
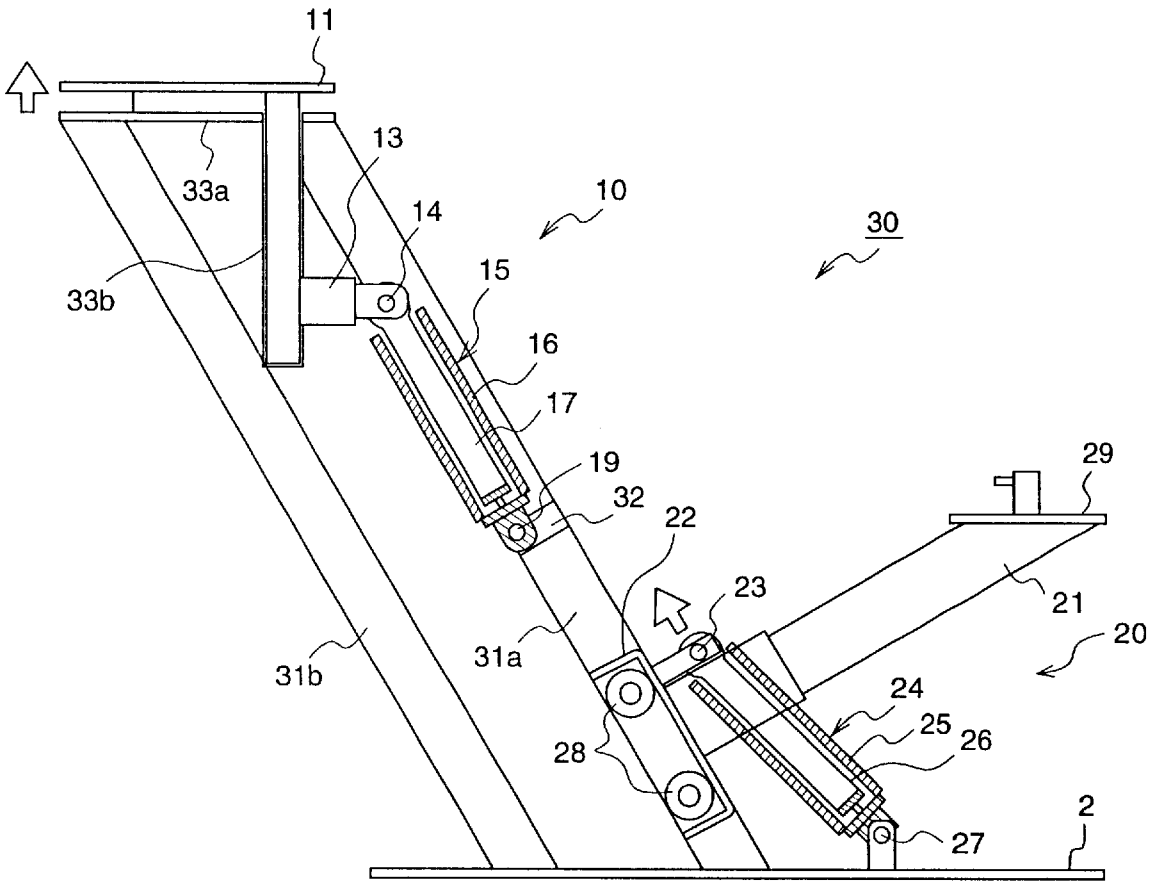
FIG. 2 is a view illustrating a cross sectional view of a frame column construction part of a hair washing apparatus according to the first embodiment of the present invention.

FIG. 2 is cross sectional view of a frame column construction part 30 of the hair washing apparatus when the bowl part 1 and the hair washing chair 40 are located at the lowest position. FIG. 3 is a cross sectional view of the frame column construction part 30 of the hair washing apparatus when the bowl part 1 and the hair washing chair 40 are moved upwardly to an appropriate position.

Figure 3:
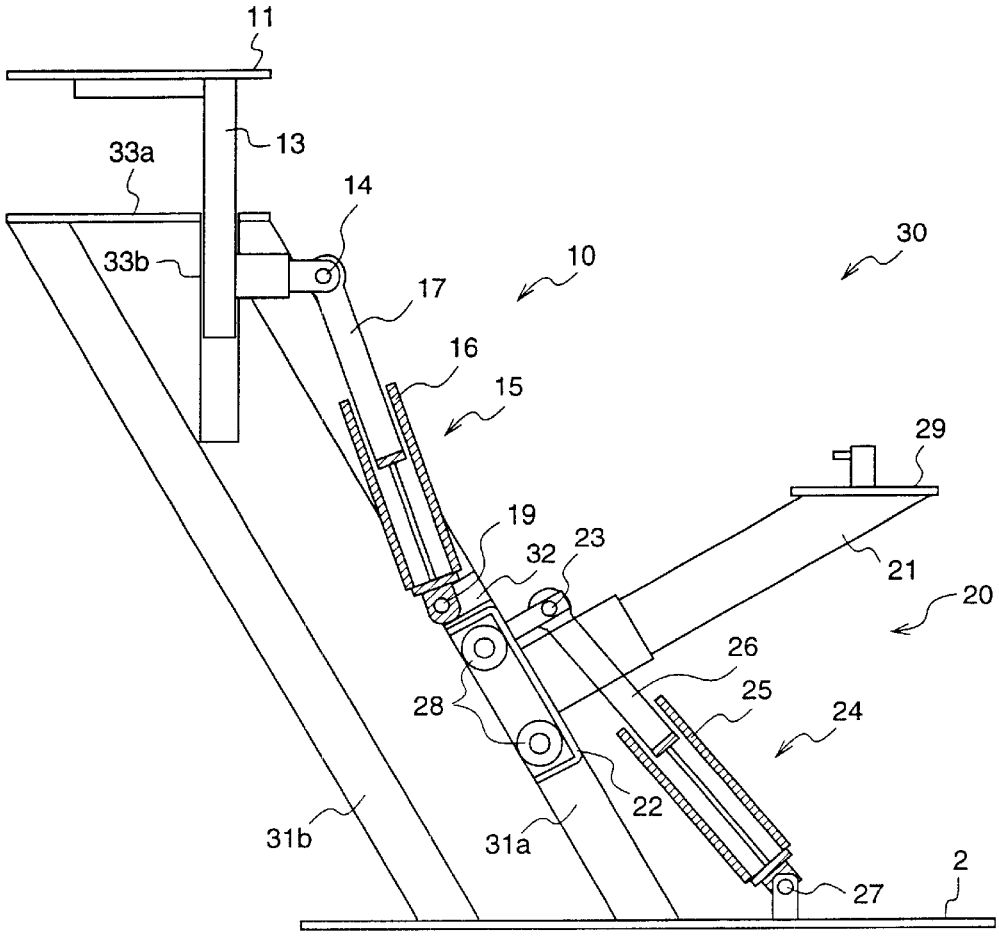
FIG. 3 is a view illustrating a cross sectional view of a frame column construction part of a hair washing apparatus according to the first embodiment of the present invention.

In FIGS. 2 and 3, the frame column construction part 30 is a frame having side faces of a parallelogram frame shape, which comprises a base part 2 as a bottom side, frames 31*a* and 31*b* as both sides, and a bowl receiving part 33 as an upper side, and an up and down movement guide arm 33*b* which extends perpendicularly and downwardly from the bowl receiving part 33*a* and a frame 32 positioned approximately at a center of the frame 31*a*.

A bowl moving up and down 10 positioned at the upper part of the frame column construction part 30 is composed of a bowl moving up and down cylinder 15, one end of which is rotatably connected to a frame 32 positioned approximately at a center of a frame 31*a* by a shaft 9, and the other end of which is rotatably fixed to a bowl moving bracket 13 by a shaft 14, and a bowl attaching part 11 for attaching a bowl part 1, which is fixed to the bowl moving bracket 13 which moves up and down along the up and down movement guide arm 33*b* by driving the bowl moving up and down cylinder 15. A chair moving up and down mechanism 20 positioned at a lower part and a front face of the frame column construction part 30 is composed of a chair moving up and down cylinder 24, one end of which is rotatably connected to a base part 2 by a shaft 27, and the other end of which is rotatably connected to a chair moving bracket 22 by a shaft 23, and a chair attaching part 29 for attaching a seat part 41 of a hair washing chair 40 to a moving chair bracket 22, which has sliding rollers 28 which move up and down along the frame 31*a* by driving the chair moving up and down cylinder 24, via a chair supporting arm 21.

Further, the bowl moving up and down cylinder 15 and a chair moving up and down cylinder 24 are hydraulic cylinders, and are composed of cylinder tubes 16 and 25, and piston rods 17 and 26, respectively. These two hydraulic cylinders are connected to a hydraulic pump 3 arranged on the base part 2 by a pipe arrangement or the like (not shown).

Further, a moving up switch 5*a* and a moving down switch 5*b* of a foot switch 5 arranged at the base part 2 are switches which are used for moving up and down the bowl part 1. A moving up switch 6*a* and a moving down switch 6*b* of a panel switch 6 for moving up and sown a chair arranged at an arm rest of the hair washing chair 40 are switches which are sued form moving up and down the hair washing chair 40. This panel switch 6 for moving up and down the chair is arranged near a seat back at the arm rest 42 so that the panel switch 6 does not become obstacles for the person to be washed when he is seated on the seat part 41.

Here, up and down movement of the bowl moving up and down mechanism 10 and the chair moving up and down mechanism 20 provided in the frame column construction part 30 will be described.

The bowl part 1 is moved up and down by the bowl moving up and down mechanism 10, thereby adjusting the height. For realizing this, initially, when the bowl moving up and down switches 5*a* and 5*b* are stepped down to switch those on, the hydraulic pump 3 is operated to pressurize or depressurize the bowl moving up and down cylinder 15, thereby extending or shortening the piston rod 17. The bowl moving bracket 13 connected to the bowl moving up and down cylinder 15 is moved up and down along the up and down movement guide arm 33*b* according to the extension and shortening of the piston rod 17, whereby the bowl part 1 is moved up and down. The up and down movement of the bowl part 1 is stopped when the bowl moving up and down switches 5*a* and 5*b* are stepped off. Therefore, a period of stepping down the bowl moving up and down switches 5*a* and 5*b* is adjusted, thereby placing the bowl part 1 at a desired height.

Further, the hair washing chair 40 is moved up and down by the chair moving up and down mechanism 20, thereby adjusting the height. For realizing this, similarly as in the above-described case of the bowl moving up and down mechanism 10, initially, when the chair moving up and down switches 6*a* and 6*b* are stepped down to switch those on, the hydraulic pump 3 is operated to pressurize or depressurize the chair moving up and down cylinder 24, thereby extending or shortening the piston rod 26. The chair moving bracket 22 connected to the chair moving up and down cylinder 24 are moved up and down along the frame 31 a by the sliding rollers 28 according to the extension and shortening of the piston rod 26, whereby the hair washing chair 40 is moved up and down. The up and down movement of the hair washing chair 40 is stopped when the bowl moving up and down switches 5*a* and 5*b* are stepped off, similarly as in the above-described case of the bowl moving up and down mechanism 10. Therefore, a period of stepping down the chair moving up and down switches 6*a* and 6*b* is adjusted, thereby placing the hair washing chair 40 at a desired height.

Next, operations in case of performing a hair washing will be described with employing the hair washing apparatus according to the first embodiment.

Initially, when a dresser (not shown) for performing hair washing wants to, for example, move up the bowl part to a desired position wherein he can easily perform a hair washing according to his height, the hair dresser steps down the bowl moving up switch 5*a*, and moves up the bowl part 1 to the desired position according to the above-described up movement of the bowl moving up and down mechanism 10. Next, the hair dresser seat a person to be washed (not shown) on the hair washing chair 40, and makes the person places his head part at the bowl part 1. At that timing, initially, the hair dresser operates the chair moving up and down switches 6*a* and 6*b* so that a height of the head part of the person to be washed is positioned approximately a the bowl part 1, and adjusts the height of the hair washing chair 40. The operation for moving up the hair washing chair 40 can be performed by the person to be washed. In such a case, the hair dresser adjusts a height of the bowl part 1 in accordance with the desired height of the hair dressing chair 40 set by the person to be washed, so that the bowl part 1 is positioned approximately at the head part of the person to be washed.

After a position of the bowl part 1 and the hair washing chair 40 are set as described above, the hair dresser tilts a seat back of the hair washing chair 40, and makes the person to be washed lie on his back, and places his head part at the bowl part 1, and then a hair washing is started. When the person to be washed feels uncomfortableness in his posture or the position of the head part to the bowl part 1 at the time when he lies on the chair, the hair dresser slightly adjusts the height of the hair washing chair 40 by operating the chair moving up and down switches 6*a* and 6*b*. Therefore, the person to be washed can receive a hair washing on the hair washing chair 40 with keeping his desired posture and the position of the head part, in which he does not feel uncomfortableness.

The above-described operations are performed in order to adjust the respective height of the bowl part 1 and the hair washing chair 40 according to height of the hair dresser and the person to be washed, and sets the height. Thereafter, the hair dresser performs a hair washing for the person to be washed.

Further, an operation of washing a nape of the person to be washed is included in the hair washing operations. When the operation is performed at the hair washing apparatus of the first embodiment, the hair dresser steps down the bowl moving down switch 5*b*, and slightly moves down the bowl part 1 according to the above-described down movement of the bowl moving up and down mechanism 10. Therefore, it is possible to easily wash his nape without raising up the head of the person to be washed, but only with keeping his head part by one hand, and further, it is possible to reduce burdens of the hair dresser during the operation. Then, the operations are completed, the hair dresser steps down the bowl moving up switch 5*a* so as to return the bowl moving up and down mechanism 10 to the original position according to the above-described up movement of the bowl moving up and down mechanism 10, and then makes the person to be washed place his head at the bowl part 1.

After the above-described hair washing operations are completed by the hair dresser, when the same hair dresser successively performs a hair washing of the other person to be washed, the hair dresser mainly adjusts a height of the hair washing chair 40 to a height of the other person to be washed who is seated on the hair washing chair 40, since the height of the bowl part 1 is already set according to the height of the hair dresser.

Further, when the other hair dresser, not the above hair dresser, performs a hair washing to the other person to be washed, the other hairdresser adjusts each height of the bowl part 1 and the hair washing chair 40 to the desired height according to height of the other hair dresser and the other person to be washed, similarly as in the above.

Figure 4:
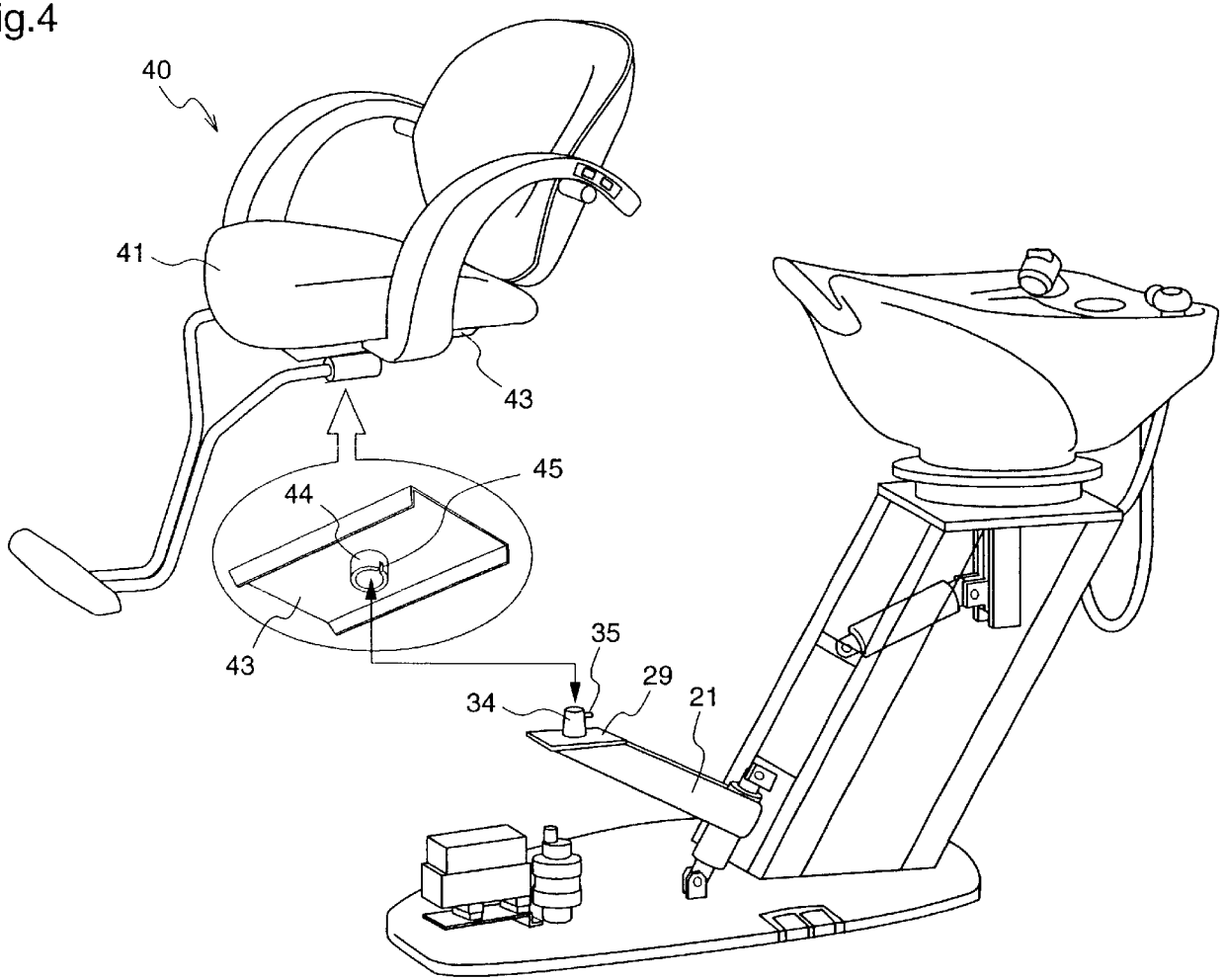
FIG. 4 is a perspective view illustrating an external appearance of a hair washing apparatus when a hair washing chair is removed from the hair washing apparatus according to the first embodiment of the present invention.

Further, according to the hair washing apparatus of the first embodiment, as illustrated in FIG. 4, the hair washing chair 40 can be removed from the hair washing unit. FIG. 4 is a view illustrating an outer appearance of the hair washing apparatus when the hair washing chair 40 is removed from the hair washing unit.

In FIG. 4, the chair attaching part 29 of the hair washing unit is provided with a chair attaching boss 34 for attaching the hair washing chair 40. The hair washing chair 40 is provided with a seat iron plate 43 which has a chair attaching bracket 44 for engaging the chair attaching boss 34 therewith, at a bottom of the seat part 41. When the hair washing chair 40 is attached to the hair washing unit, the chair attaching boss 34 is engaged with the chair attaching bracket 44 so that a chair fixing groove 45 cut at the chair attaching bracket 44 is fit to a chair fixing position determining pin 35 of the chair attaching boss 34. Whereby, the hair washing chair 40 is fixed to the chair attaching part 29 of the hair washing unit.

Figure 5:
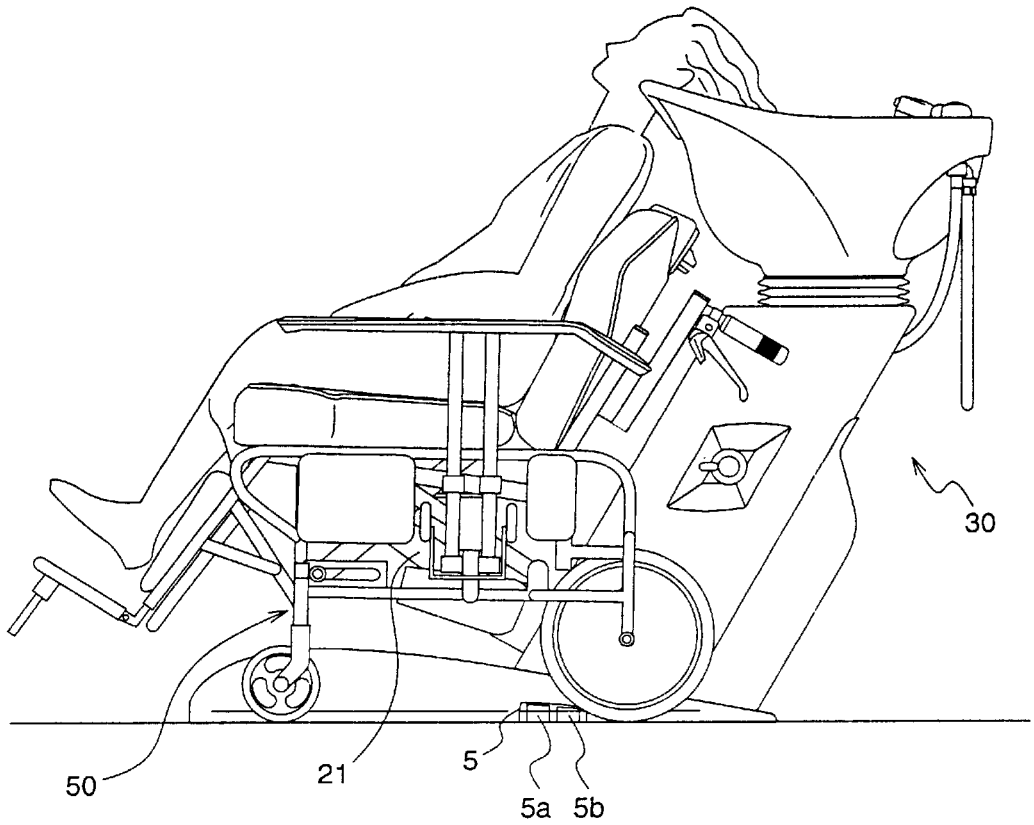
FIG. 5 is a view illustrating a state, in which a physically handicapped person on a wheelchair receives a hair washing according to a hair washing apparatus of the first embodiment of the present invention.

As described above, according to the hair washing apparatus of the first embodiment, in which the hair washing chair 40 can be easily attached to the hair washing unit and detached therefrom, if a person to be washed is a handicapped person on a wheelchair, the hair washing chair 40 is removed from the hair washing apparatus as described with referring to FIG. 4, whereby he can receive a hair washing with riding on the wheelchair 50 as illustrated in FIG. 5.

FIG. 5 is a view illustrating that a handicapped person receives a hair washing on the wheelchair according to the first embodiment.

When a hair washing is performed to the handicapped person on the wheelchair 50, initially, the hairdresser confirms whether or not the hair washing chair 40, i.e., a chair supporting arm 21, is placed at the lowest position before removing the hair washing chair 40. When the chair is not placed at the lowest position, he pressed the chair moving down switch 6*b* so as to make the chair place a t the lowest position according to the above-described down movement of the chair moving up and down mechanism 20. Then, the hairdresser removes the hair washing chair from the hair washing unit in the above-described manner, and moves the wheelchair 50 from a seat back side so as to be placed near the hair washing apparatus, and then makes the person to be washed inmovably settle the wheel chair at a position, in which the person to be washed on the wheelchair 50 can place his head part a the bowl part 1. Further, when a position of the bowl part 1 is low to a head part of the person to be washed on the wheelchair 50, the bowl moving up switch 5*a* is stepped down, or when the bowl part 1 is high, the ball moving down switch 5*b* is stepped down. Therefore, the position of the bowl part 1 is adjusted so that a height is approximately same as the height of the head part of the person to be washed according to the above-described up and down movement of the bowl moving up and down mechanism 10. Then, a hair washing is performed. Therefore, when the handicapped person on the wheelchair 50 receives a hair washing, it is not necessary for him to change from the wheelchair 50 to the hair washing chair 40, thereby sharply reducing burdens of the person to be washed, due to the change.

Figure 6:
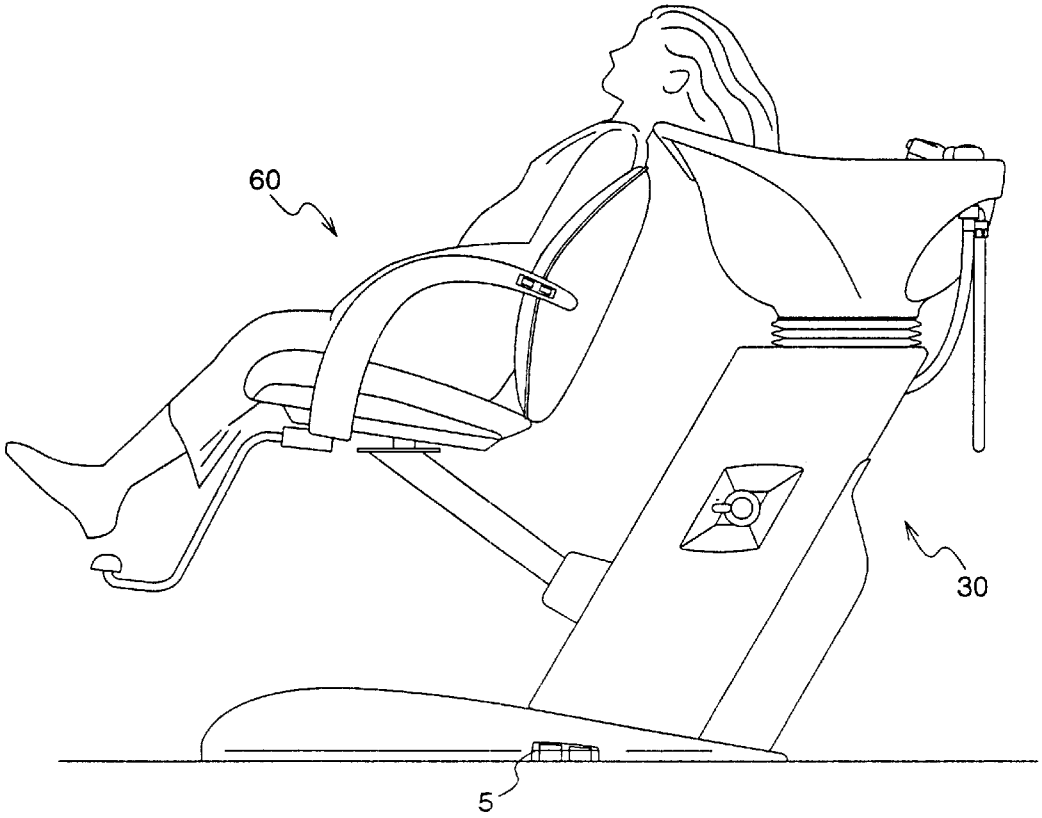
FIG. 6 is a view illustrating a state, in which a pregnant mother who is near the last month of pregnancy receives a hair washing on a hair washing chair for a pregnant woman according to a hair washing apparatus of the first embodiment of the present invention.
Figure 7:
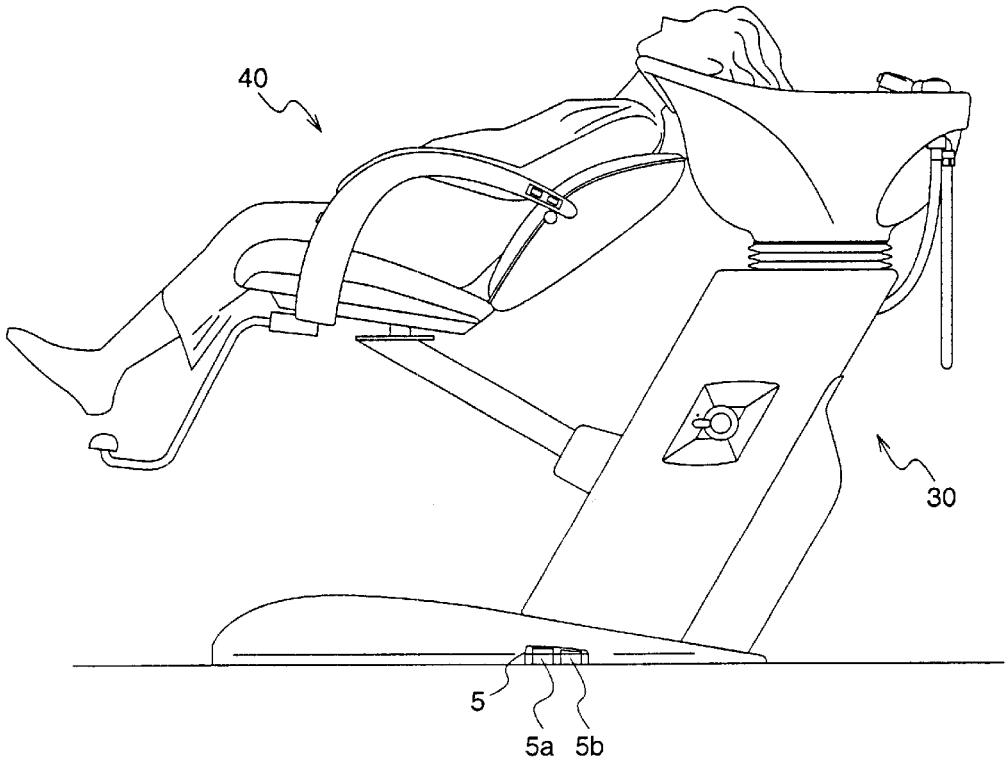
FIG. 7 is a view illustrating a state, in which a pregnant mother who is near the last month of pregnancy receives a hair washing on a usual hair washing chair according to a hair washing apparatus of the first embodiment of the present invention.
Figure 8:
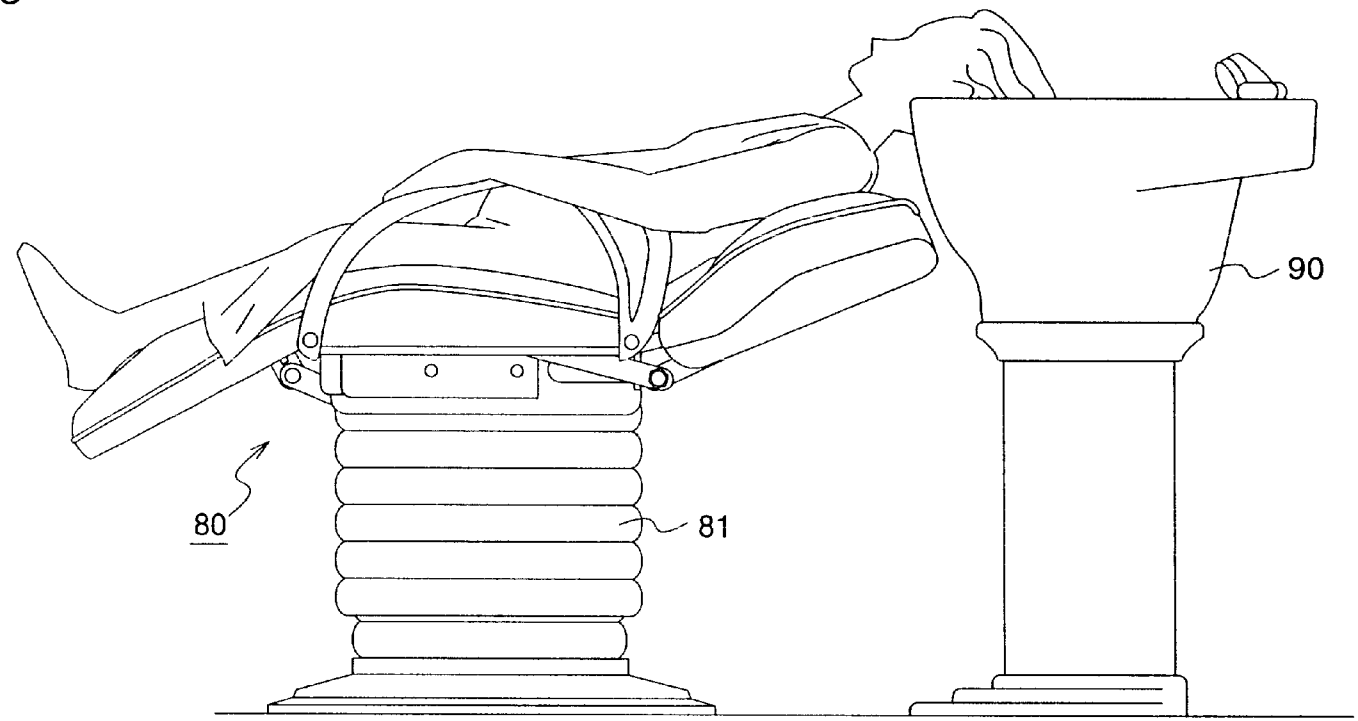
Fig.8 Prior Art
FIG. 8 is a view illustrating that a person to be washed receives a hair washing according to a conventional hair washing apparatus.

Further, according to the hair washing apparatus, as an another example for removing the hair washing chair 40 from the hair washing unit, a case in which a person to be washed is a pregnant woman who is near the last month of pregnancy, will be described. FIG. 6 is a view illustrating that a pregnant mother who is near the last month of pregnancy receives a hair washing on a hair washing chair for a pregnant woman. FIG. 7 is a view illustrating that a pregnant mother who is near the last month of pregnancy receives a hair washing on a usual hair washing chair.

According to the usual hair washing chair 40, the chair is tilted until the seat back is approximately flatted, as illustrated in FIG. 7. However, the flattened state results in a posture which increases burdens to an abdominal region of the pregnant woman who is near the last month of pregnancy. Therefore, when a hair washing is performed to the pregnant woman who is near the last month of pregnancy according to the hair washing apparatus, in which the chair can be easily removed from the hair washing unit, the hairdresser removes the conventional hair washing chair, a seat back of which is approximately flattened as illustrated in FIG. 7, from the hair washing unit, and replaces the same by a hair washing chair for a pregnant woman 60, which cannot be tilted until only to an angle which is a little wider than a tilted angle of an office chair, as illustrated in FIG. 6. Then, a hair washing for the pregnant woman who is near the last month of pregnancy is performed with employing the hair washing chair 60. Therefore, it is possible to reduce burdens to the abdominal region of the pregnant woman who is near the last month of pregnancy.

As described above, when the hair washing apparatus according to the first embodiment is employed, regardless of height of a hairdresser for performing a hair washing and a person to be washed who receives a hair washing, the bowl part 1 and the hair washing chair 40 can be adjusted according to the all combinations, whereby it is possible to set the height to a desired position of the hairdresser and the person to be washed. Thus, the hairdresser can perform a hair washing at his desired height, thereby reducing burdens to his lumber region during a hair washing performance. Further, a position of a head part or a posture of the person to be washed during a hair washing can be set in a desired state. Therefore, it is possible to reduce burdens to both of the hairdresser and the person to be washed.

Further, according to the hair washing apparatus of the first embodiment, since the hair washing unit is provided with the hair washing chair 40, it is possible to easily arrange the hair washing apparatus at a barbershop or a beauty salon, and also possible to easily move the same. Further, the hair washing chair 40 provided with the hair washing unit can be easily removed from the hair washing unit. Therefore, if a person to be washed is a handicapped person on a wheelchair or a pregnant woman who is near the last month of pregnancy, the hair washing chair 40 can be removed or replaced according to a condition of the person to be washed, thereby reducing burdens of the person to be washed during a hair washing.

Further, the hair washing apparatus is provided with the bowl moving up and down mechanism 10 and the chair moving up and down mechanism 20 in the frame column construction part 30, thereby making an area for arranging the hair washing apparatus small.

What is claimed is:

1. A hair washing apparatus comprising:

a hair washing unit having a hair washing bowl for performing a hair washing; and a hair washing chair connected to the hair washing unit by a chair supporting arm, on which a person to be washed is seated, wherein the hair washing unit is provided with a hair washing bowl moving up and down mechanism for moving up and down the hair washing bowl, and a hair washing chair moving up and down mechanism for moving up and down the chair supporting arm connected to the hair washing chair, wherein the hair washing bowl moving up and down mechanism has a bowl moving up and down cylinder, one end of which is connected to a frame, and the other end of which is connected to a bowl moving bracket, and a bowl attaching part for attaching the hair washing bowl to an upper end of the bowl moving bracket, wherein the hair washing bowl is moved up and down by driving the bowl moving up and down cylinder, and the hair washing chair moving up and down mechanism has a chair moving up and down cylinder, one end of which is connected to a base part arranged on a floor face, and the other end of which is connected to a chair moving bracket, the chair supporting arm being connected to the chair moving bracket, and a chair attaching part for detachably attaching a chair being connected to the chair supporting arm with said chair attaching part being in parallel to the base part, wherein the hair washing chair is moved up and down by driving the chair moving up and down cylinder.

2. The hair washing apparatus described in claim 1, wherein the hair washing unit has a frame, a front shape of which is rectangular, and a side shape of which is a parallelogram, the hair washing bowl moving up and down mechanism includes an up and down movement guide arm extending perpendicularly and downwardly from an upper surface which is provided at an upper side of the frame, the bowl attaching part being provided in parallel to the upper surface of the frame and movable upwardly and downwardly, and the bowl moving bracket, which is fixed to a bottom face of the bowl attaching part and extends perpendicularly and downwardly from the bottom face thereof, and further the bowl moving bracket moves up and down along the up and down movement guide arm, and the hair washing chair moving up and down mechanism has the chair moving bracket moving along an inclined front face of the frame and driven by sliding rollers provided at the chair moving bracket.

* * * * *

UNITED STATES PATENT AND TRADEMARK OFFICE

CERTIFICATE OF CORRECTION

PATENT NO. : 6,463,597 B2
DATED : October 15, 2002
INVENTOR(S) : Yoshikazu Ishimura It is certified that error appears in the above-identified patent and that said Letters Patent is hereby corrected as shown below:

Column 1,
Line 31, after the phrase "chair 80, and moves up the up and" please delete "don" and replace with the word -- down --.
Line 49, at the end of the sentence please delete "pat" and replace with the word -- part --.

Column 2,
Line 52, after the phrase "front face and" please delete "th" and replace with the word -- the --.

Column 4,
Line 52, after the phrase "moving up and" please delete "sown" and replace with the word -- down --.

Signed and Sealed this

Eleventh Day of February, 2003

JAMES E. ROGAN
*Director of the United States Patent and Trademark Office*